US008079774B2

(12) United States Patent
House et al.

(10) Patent No.: US 8,079,774 B2
(45) Date of Patent: Dec. 20, 2011

(54) TRAFFIC BARRIER WITH QUICK-BOLT CONNECTION SYSTEM

(75) Inventors: Randall House, San Antonio, TX (US); Jorge D. Hinojosa, Bulverde, TX (US); Freddie Birck, Boerne, TX (US); Randall Frerich, San Antonio, TX (US)

(73) Assignee: Bexar Concrete Works I, Ltd., San Antonio, TX (US)

( * ) Notice: Subject to any disclaimer, the term of this patent is extended or adjusted under 35 U.S.C. 154(b) by 79 days.

(21) Appl. No.: 12/778,463

(22) Filed: May 12, 2010

(65) Prior Publication Data

US 2010/0290832 A1 Nov. 18, 2010

Related U.S. Application Data

(60) Provisional application No. 61/177,702, filed on May 13, 2009.

(51) Int. Cl.
*E01F 15/08* (2006.01)

(52) U.S. Cl. ..... 404/6; 256/13.1

(58) Field of Classification Search ..... 404/6; 256/13.1
See application file for complete search history.

(56) References Cited

U.S. PATENT DOCUMENTS 3,678,815 A * 7/1972 Younker ..... 14/73
4,113,400 A 9/1978 Smith
5,149,224 A 9/1992 Smith
5,156,485 A 10/1992 Ivey
5,443,324 A 8/1995 Sullivan
5,464,306 A 11/1995 Cristiano
5,685,665 A * 11/1997 Lembo ..... 404/6
5,975,793 A 11/1999 Simmons
6,176,638 B1 * 1/2001 Kellison et al. ..... 403/268
6,413,009 B1 7/2002 Duckett
6,851,887 B2 * 2/2005 Lembo ..... 404/6
7,144,186 B1 12/2006 Nolte

OTHER PUBLICATIONS

"Development of Low-Deflection Precast Concrete Barrier," Report No. FHWA/TX-05/0-4162-3, Jan. 2005, Texas Transportation Institute, The Texas A&M University System.

* cited by examiner

*Primary Examiner* — Raymond Addie
(74) *Attorney, Agent, or Firm* — Daniel D. Chapman; Jackson Walker LLP

(57) ABSTRACT

A coupling system for a traffic barricade has at least first and second traffic barrier segments adapted to be coupled in abutting alignment. First and second connectors are movable from a retracted position in upper and lower bolt retraction cavities in the first barrier segment to a second coupled position wherein ends of each of the connectors pass through connecting rod shafts in the second barrier segment and secure abutment of the first and second traffic barrier segments. Hand holes are provided in each segment to enable assemblers to move the connectors from the first to the second position.

8 Claims, 10 Drawing Sheets

TRAFFIC BARRIER WITH QUICK-BOLT CONNECTION SYSTEM

This is a utility patent application that claims priority from and incorporates herein by reference, U.S. Provisional Patent Application Ser. No. 61/177,702, filed May 13, 2009.

BACKGROUND

The present invention relates to an improved barrier connection system. More particularly, the present invention relates to concrete barricades having a unique "quick-bolt" system for securing one barrier segment to an adjacent barrier segment.

Currently there are a number of coupling or connection systems available to interlock a plurality of rigid segments disposed end to end in interlocking relationship with one another. These interlocked segments, which are generally made of precast concrete, are joined to form elongated barriers or barricades along roadways and are important in blocking off areas from traffic, delineating driving lanes, and otherwise controlling the flow of traffic along highways. In appropriate environments, the segments may be fabricated of high strength plastic composition.

Popular profiles for such segments are the F-shape; jersey-style; single slope; and low-profile or rectangular style. Many names are used for such barriers as is well-known in the art. The present inventive connection system is effective for both high speed, high force impacts, and low speed, low force impacts.

Portable concrete barriers may be utilized to positively protect workers in a highway work zone. Highway work zones are restricted by the availability of lateral space accommodating traffic and work activity. To ensure work safety, a buffer zone is required between the work activity and the barrier. This is because vehicular contract with a barrier may cause it to deflect in the direction of the worker. The area along the barricade most likely to deflect is the connection joint between two joined segments.

Examples of existing coupling or connection systems include U.S. Pat. Nos. 7,144,186; 6,413,009; 5,975,793; 5,464,306; 5,443,324; 5,156,485; 5,149,224; and 4,113,400. A Jan. 2005 report entitled "Development of Low-Deflection Precast Concrete Barrier, Report No. FHWA/TX-05/0-4162-3, Texas Transportation Institute, The Texas A&M University System, College Station, Tex. 77843-3135, disclosed a cross-bolt, precast concrete barrier for use as a work zone barrier. The barrier in the 2005 report utilized connector bolts placed in different horizontal planes at an angle of 20 degrees with respect to the longitudinal axis of the barrier. The bolts exit one barrier segment and enter the adjacent barrier at the vertical centerline of the barrier section.

Despite the advantage of the cross-bolt design, the installation time for the system and the degree of barrier deflection upon impact have not proven as cost saving and effective as the present system. Securing connection hardware from theft and loss both before and after assembly of segments has also been a problem.

Thus there still exists a long-felt need for a barrier with a simple, easy to use, connection system which resist deflection well within the tolerances of the various state departments of transportation standards.

SUMMARY OF THE INVENTION

The present inventive connection system may be utilized with all types of barrier profiles and compositions. However, as an example of a specific embodiment, the discussion below describes precast concrete segments of a particular size. The size, strength, and material composition of a segment is dependent on the environment of use and will be well understood by one of ordinary skill in the art.

The precast concrete segments used in the construction of a particular elongated barrier or barricade may be 30 feet in length and have the standard F-shape profile. The barrier segments may be 32 inches in height, 24 inches wide at the base, and 9½ inches wide at the top.

Horizontal reinforcement consists of eight #5 bars (or equivalent) placed symmetrically about the vertical centerline of the barrier segment. Vertical reinforcement may consist of #4 bars spaced 12 inches on center. Spacing of the vertical bars may be reduced to provide additional strength within 5 feet of the barrier segment ends.

Sections of pipe forming a sleeve are horizontally cast into the end of each segment to provide access for feeding a threaded rod from one barrier into another and for securing the nuts and washers once the rod is in place. A bolt retraction cavity extends from a hand hole further into the body portion of the barrier. "Hairpin" shaped bars extend horizontally along the top and bottom of the pipe sleeve, hand hole, and bolt retraction cavity. Reinforcing stirrup bars enclose these hairpin bars to provide further strength to the connection. The barrier connection is made with connector rods. A washer and nut are used on each end of the threaded rod to secure the connection.

An example of a complete elongated barricade may include eight barrier segments connected together for a total length of approximately 240 ft. The concrete may be specified to be 3600 psi and reinforcing steel may be grade 60. The threaded rods may be fabricated from SAE Grade 5 or equivalent steel, and the plate washers may be A-36 steel. Details of one embodiment of a barrier segment are described below.

BRIEF DESCRIPTION OF THE DRAWINGS

FIG. 158 illustrates the S2 bar of the present invention with dimensions.

DESCRIPTION OF THE PREFERRED EMBODIMENT

Figure 1:
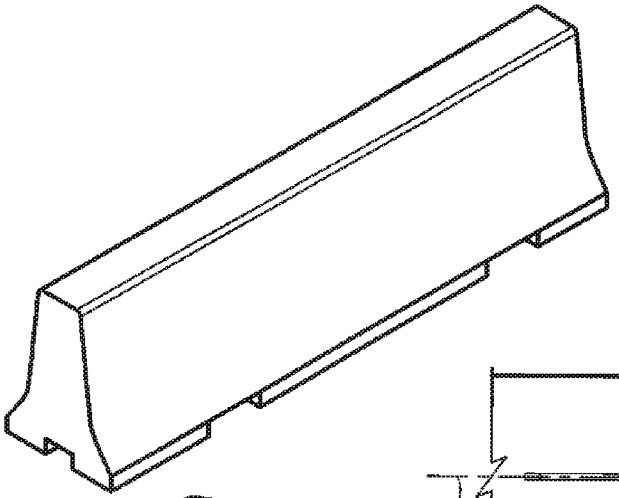
Fig. 1 (Prior Art)
FIG. 1 illustrates a perspective view of a standard barrier segment of the prior art.

As noted above, a popular traffic barrier segment design is shown in FIG. 1. A number of coupling mechanisms have been used to connect adjacent barriers to create elongated barricades having lengths of approximately 240 feet. Lengths may be adjusted as appropriate for the particular traffic environment.

Figure 2A:
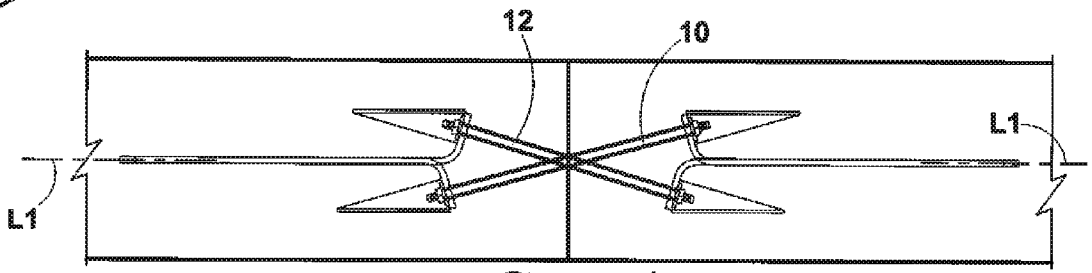
Fig. 2A (Prior Art)
FIG. 2A is a top plan view of a cross-bolt connection system of the prior art joining adjacent barrier segments.
Figure 2B:
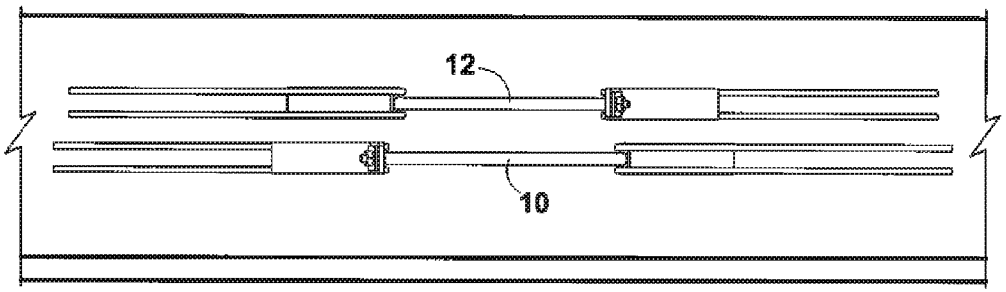
Fig. 2B (Prior Art)
FIG. 2B shows a side elevation view of a cross-bolt connection system of the prior art joining adjacent barrier segments.

FIGS. 2A and 28 illustrate one prior art coupling system known as the cross-bolt design. Bolts 10 and 12 are placed in different horizontal planes at an angle of 20 degrees with respect to the longitudinal axis $L_1$ of the barrier segment. The bolts exit one barrier segment and enter the adjacent barrier at the vertical centerline of the barrier section.

Figure 3A:
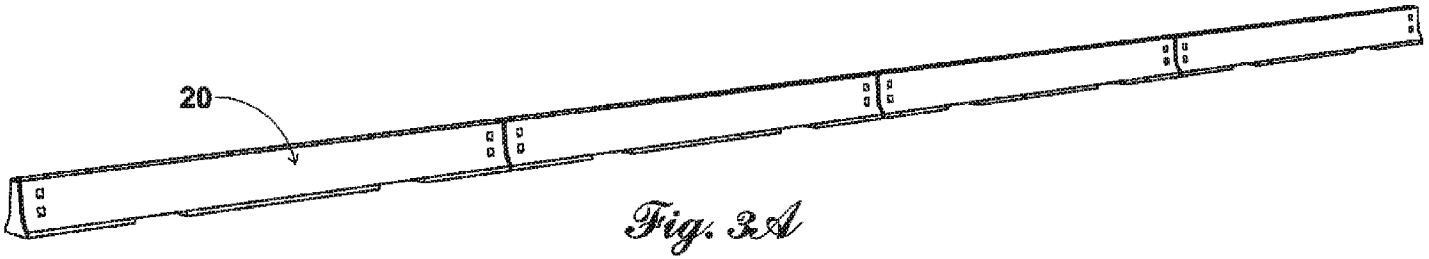
FIG. 3A illustrates a front perspective view of an elongated barricade formed by the connection of several barrier segments of the present invention. The elongated barricade is set up for an impact test.
Figure 3C:
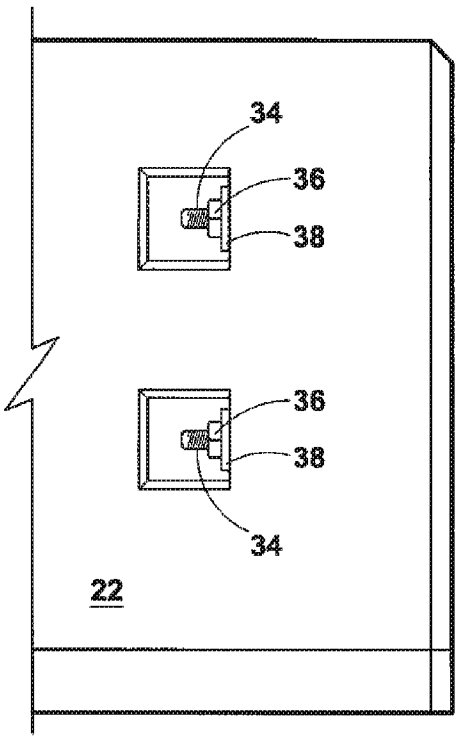
FIG. 3C is a detail view of the upper and lower hand holes of one of the adjacent segments with threaded connector rods, washers, and threaded nut connected to join a second adjacent segment.
Figure 3B:
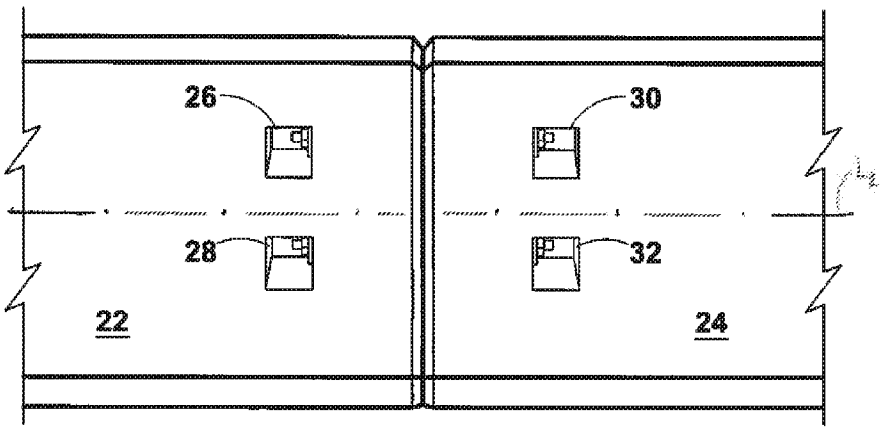
FIG. 3B is a front, face perspective view of adjacent barrier segments coupled with the present inventive connection. The hand holes of the present invention are shown.

To give some perspective to how numerous segments may be joined, FIG. 3A illustrates an elongated barricade 20 made up of individual segments joined with the coupling system of the present invention. This barricade 20 has been set up for a vehicular impact test. As will be described further below, the present connection or coupling system enables the elongated barricade to be quickly assembled. The connection hardware may be stored within the body portion of the barrier before and after assembly of segments. Adjacent barrier segments 22 and 24 (FIG. 3B), each having a longitudinal axis $L_2$, are brought together with ends abutting and the longitudinal axes in alignment. Each barrier segment has an upstream end and a downstream end. Hand holes 26, 28, 30, and 32 enable assemblers to reach within the body of barrier segments along the front face and couple connecting rods 34 with fastening bolts 36 and retaining washers 38 as seen in FIG. 3C. Such coupling brings the upstream end of one segment into abutting alignment with the downstream end of the adjacent barrier segment.

Figure 4:
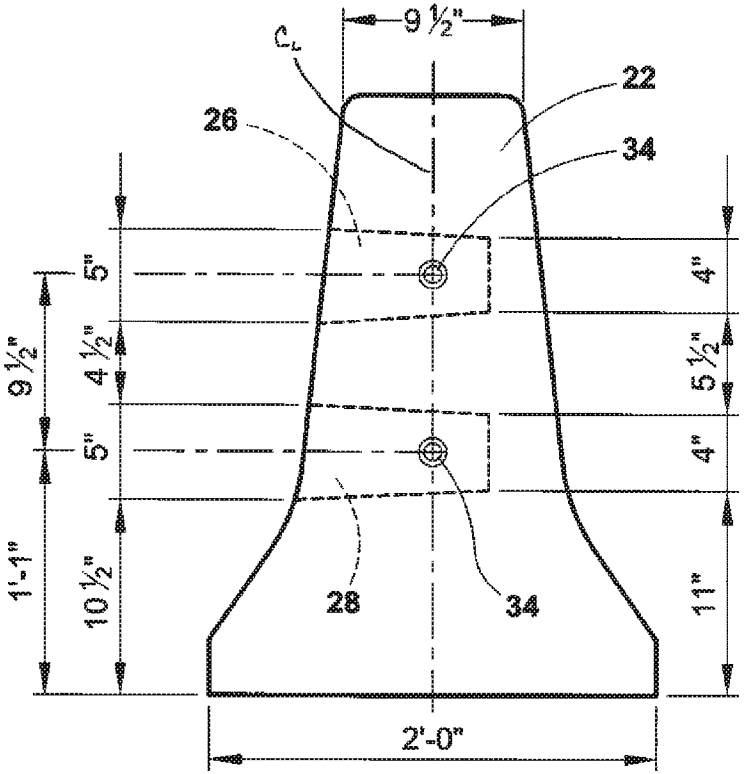
FIG. 4 illustrates an end elevation view of the present inventive barrier segment showing the location of the connector rods and hand holes in the barrier.
Figure 5D:
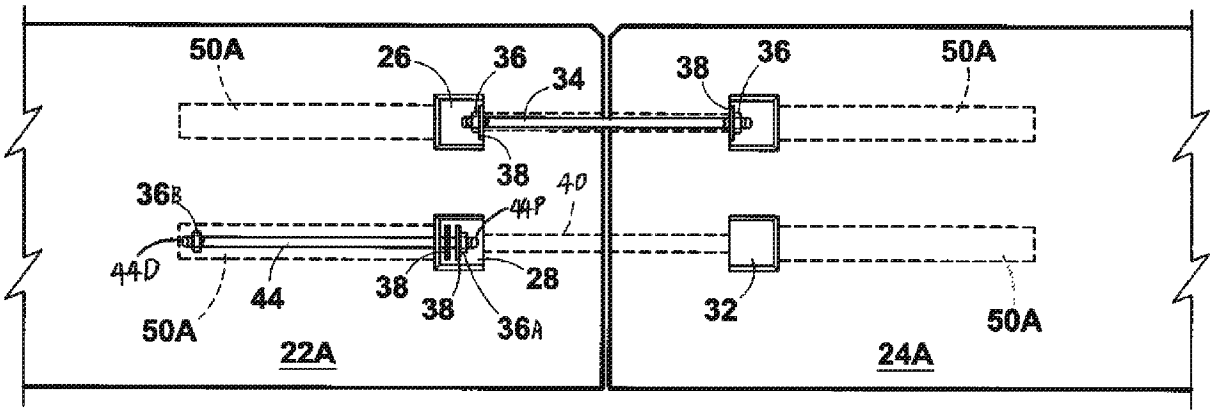
FIG. 5A illustrates a front face elevation view of another embodiment of adjacent barrier segments with the upper connector rod fastened and the lower connector rod not fastened and withdrawn into an extended retraction cavity with the washers and threaded nuts secured on the withdrawn rod.

FIG. 4 illustrates an end elevation view showing the profile of barrier segment 22. The size and dimensions described are illustrative of a typical barrier segment, but sizes and dimensions may be varied to provide various strengths to the system. The typical segment is 32 inches in height, 24 inches wide at the base, and 9½ inches wide at the top. The connector rods are situated along the vertical centerline $C_L$ of each segment and spaced apart 9½ inches. Again, the rods 34 extend generally parallel the longitudinal axis of each segment. The upper connector rod 34 may be reached through tapering hand hole 26, while lower connector rod 44 may be reached through tapering hand hole 28. The spacing and disposition of the hand holes and rods relative to the end profile are noted in FIG. 4.

Figure 5:
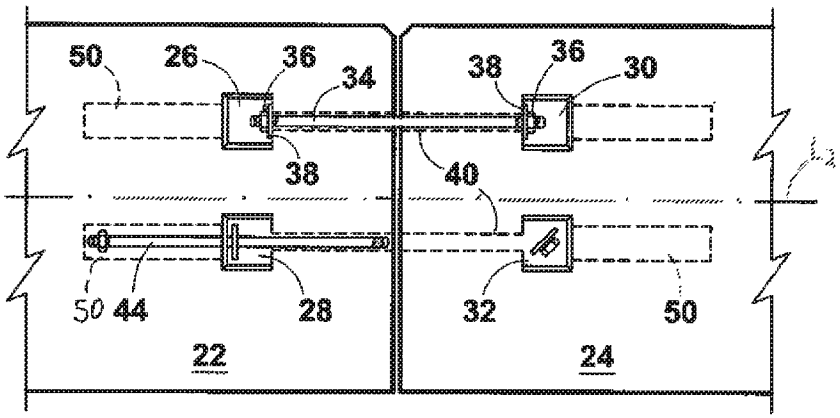
FIG. 5 illustrates a front face elevation view of adjacent barrier segments with the upper connector rod fastened and the lower connector rod not fastened.
Figure 14A:
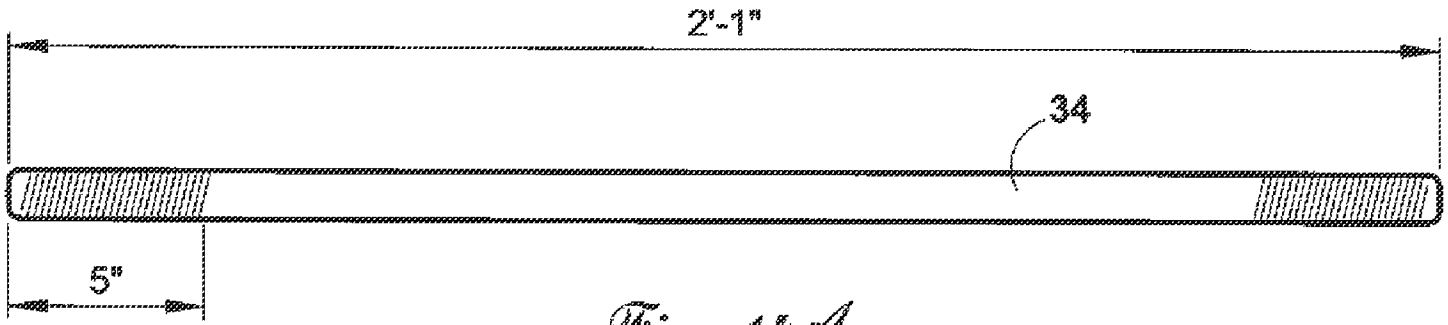
FIG. 14A illustrates the threaded connector rod of the present invention.

A front elevation view of one embodiment of abutting adjacent barrier segments is shown in FIG. 5. Ten inch long sections of 1½ inch diameter PVC pipe are horizontally cast into the end of each segment to form sleeves 40. It should be understood that different sized pipes may be utilized as appropriate. These piping sleeves 40 extend generally parallel to the longitudinal axis $L_2$ and generally on the vertical centerline $C_2$ of each segment. The sleeves 40 provide access for feeding threaded rods 34, 44 from one barrier into another. In one embodiment, each connection rod is a ⅞ inch diameter, 25 inches long, steel bolt threaded at each end (FIG. 14A). FIG. 5 illustrates rod 34 fastened at both ends by fastener nuts 36 (FIG. 14B) and retained in the sleeve 40 by retaining washers 38.

Figure 14C:
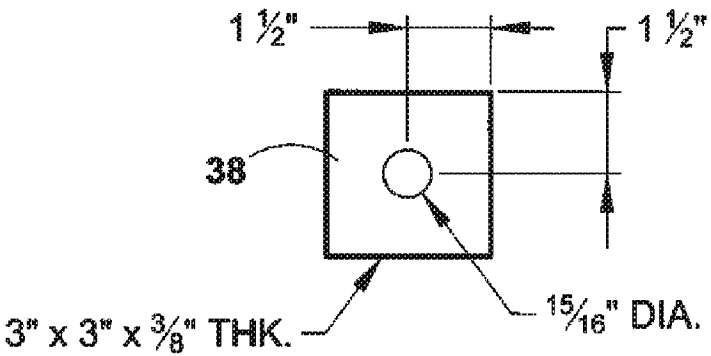
FIG. 14C shows the retaining washer of the present invention.

A second rod 44 is shown in FIG. 5 as withdrawn into bolt retraction cavity 50 (3" diameter×12" long) of segment 22 while its associated, opposite fastener nut and retaining washer are disposed in hand hole 32 in segment 24. The retaining washers are 3 inch square, ⅜ inch thick steel plate (FIG. 14C). The axis of each retraction cavity is generally parallel to the longitudinal axis $L_2$ of each segment and also lies generally along the vertical centerline $C_L$ of the segment.

It may be understood from FIG. 5 that in one embodiment of the present invention bolt retraction cavities 50 in each segment allow for coupling hardware (rod, washer, and nut) to be retained in the end of the segment with the rod retracted so that no part of the rod projects beyond the end of the barrier segment when retracted. The opposing, complimentary washer and fastener nut may be stored in a segment to be abutted. This enables the segments to be abutted quickly, the rods urged forward out of the cavity and slid into the opposing PVC sleeve and into the expanded open space (5"×5") of the hand hole. The opposed washer and nut are then attached to the end of the rod and the segments are secured together by tightening the fastener nut.

FIG. 5A shows an alternative embodiment wherein the barrier segments 22A and 24A are provided with extended retraction cavities 50A in each segment which allow the coupling hardware (rod, washers, and nuts) for both ends of the coupling to be retained in one segment. Each extended retraction cavity 50 is sized to accommodate the entire length of the rod 44 or 34 within the length of the cavity 50A and the hand hole 28. Thus, the extended retraction cavity 50A may have a depth in the range of approximately 20" to approximately 22" to allow the rod 34 to withdraw sufficiently to expose the threaded portion of the rod in the open hand hole and facilitate the affixation of the connective hardware.

The distal end of rod 44D is shown in FIG. 5A retracted into the innermost end of the cavity 50A with a fastener nut 36B affixed to the threaded distal end 44D of the rod 44. The proximal end 44P of rod 44 is withdrawn into the hand hole 28 of the segment 22A and does not extend into the piping sleeve 40.

The first and second washers 38 are sized such that they are not easily drawn into the retraction cavity 50A; they remain loosely attached to the proximal end 44P of the connecting rod 44. The washers 38 are smaller than the size of the hand hole opening 28 and may be slipped on or off the rod when the fastener nut 36A on the threaded proximal end 44P of the rod 44 is removed. In one embodiment, the hand hole opening is 5"×5" while the washer is 3" square. During storage, the nuts 36A and 36B are affixed to the ends of the rod 44 with the washers 38 disposed in the hand hole 28. It may be seen from the figures that in this stored position, the rod 44 with the washers 38 attached by the nuts 36A and 36B will not slide out of the segment 22A through piping sleeve 40, because the size of the washers is greater than the diameter of the piping sleeve 40. Thus, when the segments are in storage or in transit to the placement location, the hardware is safe and secure within the individual segment.

Figure 6:
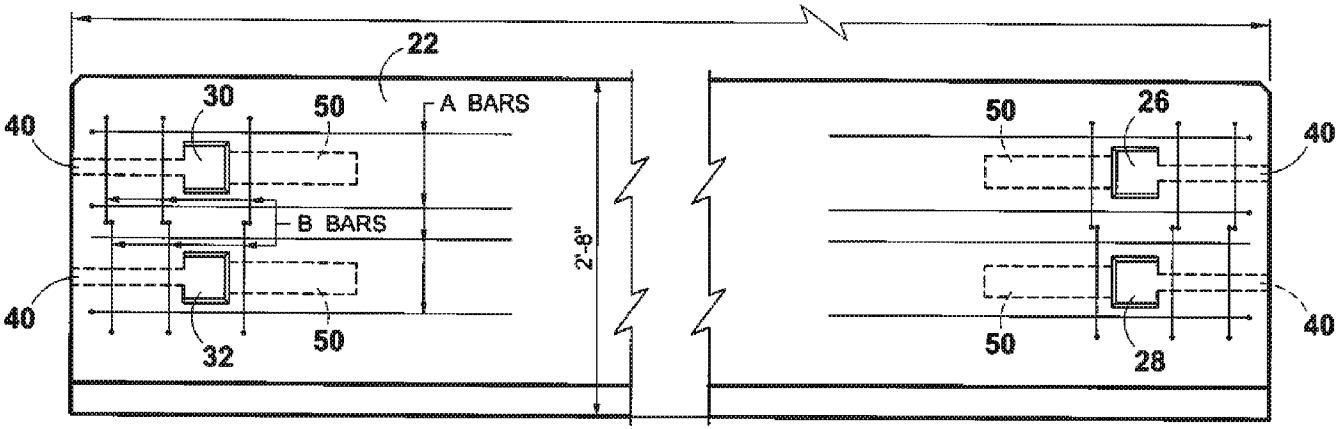
FIG. 6 shows a front elevation view of a barrier segment of the present invention (broken length) indicating the disposition of the pipe shaft, the hand holes, the bolt retraction cavity, and reinforcement bars.
Figure 15A:
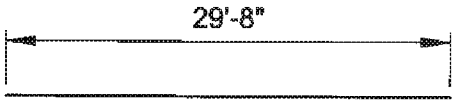
FIG. 15A illustrates the R1 bar of the present invention with dimensions.
Figure 15B:
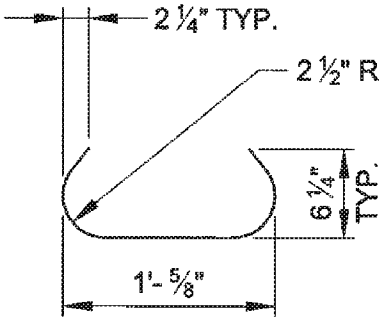
FIG. 15C illustrates the S3 bar of the present invention with dimensions.
FIG. 15D illustrates the A bar of the present invention with dimensions.
FIG. 15E illustrates the B bar of the present invention with dimensions.
Figure 15E:
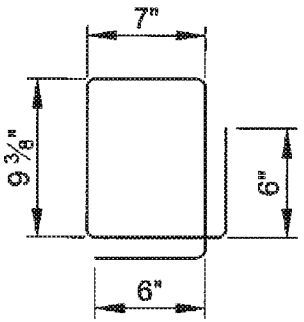
Figure 15C:
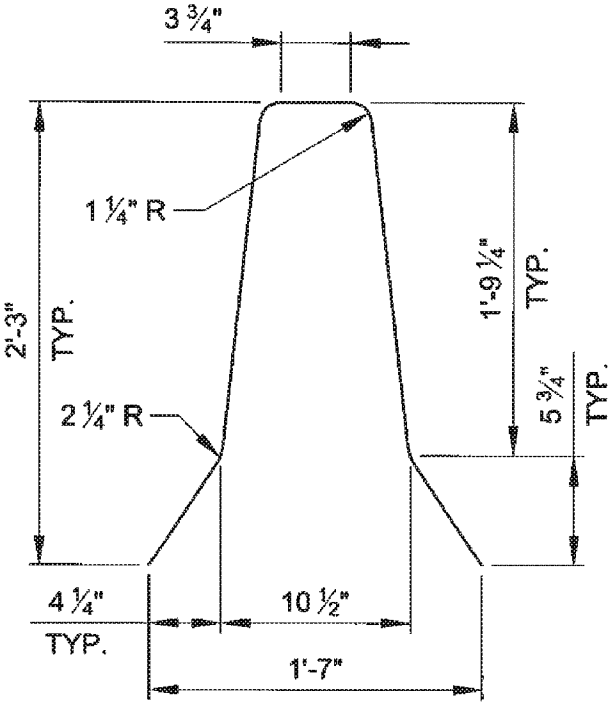
Figure 15D:
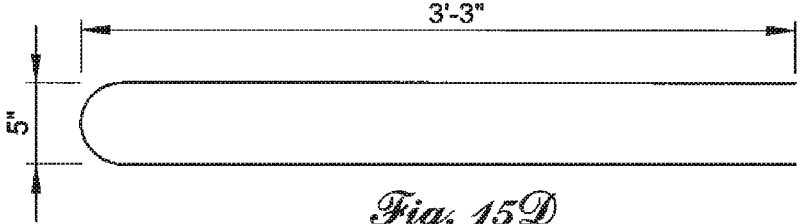

FIG. 6 illustrates a front elevation plan view of a barrier segment 22 of the present invention with connecting rod sleeves 40; tapering hand holes 26, 28, 30, 32; and bolt retraction cavities 50 at each end of the segment 22. Two #5 "hairpin" shaped A bars (FIG. 15D) extend horizontally along the top and bottom of the PVC sleeves 40; hand holes 36, 28, 30, 32; and the bolt retraction cavities 50. Three #5 stirrup B bars (FIG. 15E) enclose these A bars to provide further strength to the connection.

As described earlier, the coupling hardware may be retained within each segment to improve the speed of assembly and to secure the connective hardware. FIG. 7 illustrates a top plan view of barrier segment 22 showing the disposition of connector rod 34 with fastener nut 36 attached and positioned in bolt retraction cavity 50. Retaining washer 38 is disposed at the tapering hand hole 26 and the opposite threaded end of rod 34 extending into PVC sleeve 40, but not beyond the end face 41 of the barrier segment to form the coupling interlocking the two segments. Rod 34 cooperates with hardware in an adjacent segment. FIG. 7 further shows at the opposite end of segment 22 retaining washer 38 and fastener nut 36 disposed at tapering hand hole 30 for attachment to a cooperating connecting rod from an adjacent barrier segment. It should be understood that the hardware may be retained in either end of the segment.

Figure 7D:
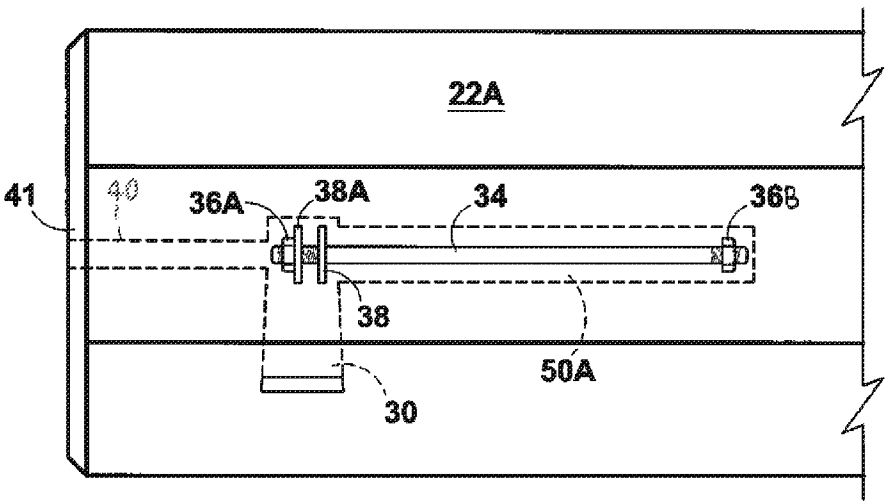
FIG. 7 is a top plan view of a barrier segment of the present invention (broken length) showing a connector rod with nut in the bolt retraction cavity on one end of the segment and a retaining washer and nut in the hand hole at the opposite end of the segment.
FIG. 7A illustrates a top plan view of the embodiment of FIG. 5A of the present invention with an extended retraction cavity showing a connector rod fully retracted and connector hardware affixed to the retracted rod for storage.
Figure 7:
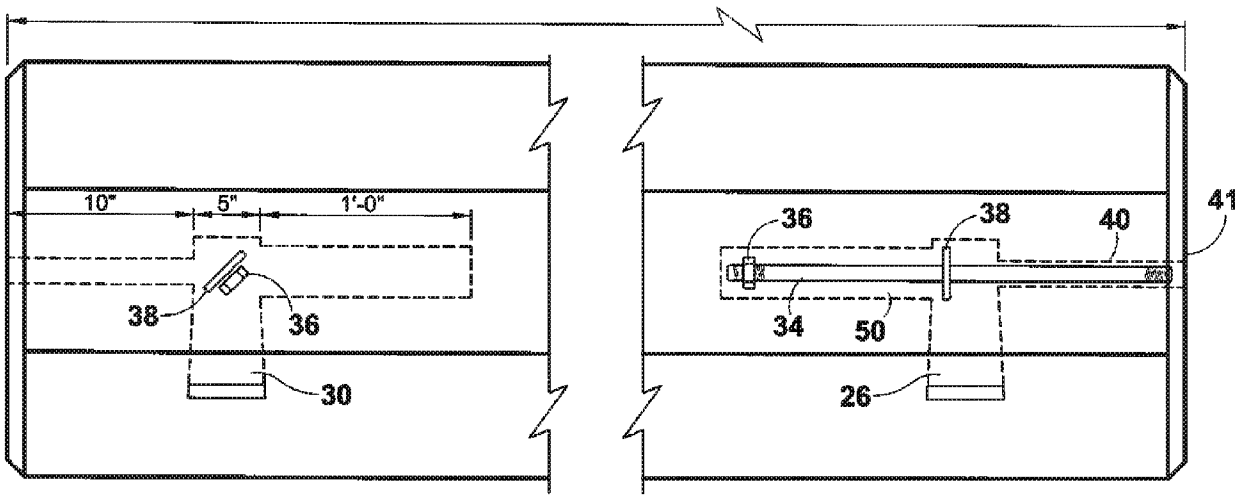

As noted in FIG. 7A, the connective hardware may be stored or retained within the body of the segment 22A to ensure it is secure and not subject to damage before used to join abutting segments. The retract cavity 50A is of sufficient length in relation to the length of the rod 34, to allow the rod 34 with a fastener nut 36B affixed to be slid into the body of the segment thereby disposing the opposite threaded end 40 to align with the hand-hole 30. An operator may reach into the hand hole and attach the washers 38 and 38A around the rod and affix the fastener nut 36A to the rod.

Because the washers are larger in size than the sleeve 40, the hardware cannot slide out of the body of the segment 22A and be exposed to loss or damage. Further, having the connective hardware all in one segment facilitates storage, transport, and assembly.

Figure 8:
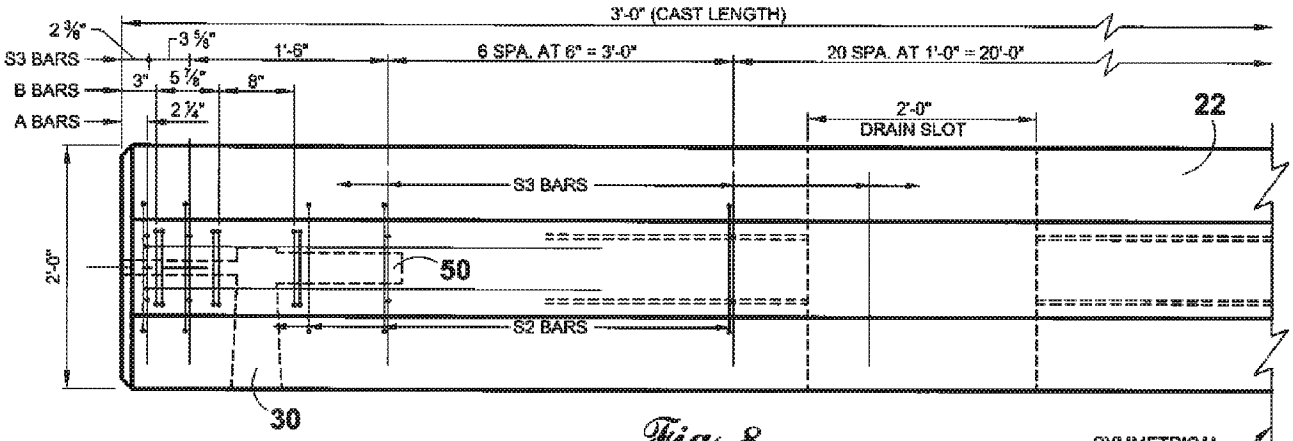
FIG. 8 illustrates a top plan view of one end of a barrier of the present invention showing the location, distances, and dimensions for reinforcement bars.
Figure 9:
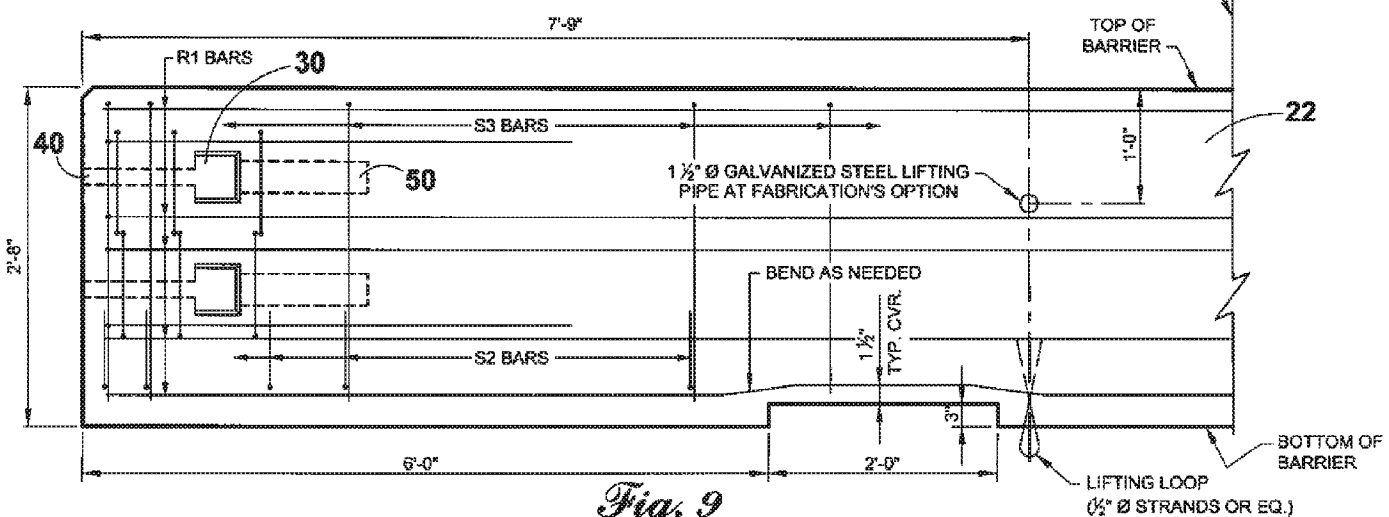
FIG. 9 illustrates a front elevation plan view of the barrier segment of FIG. 8.
Figure 11:
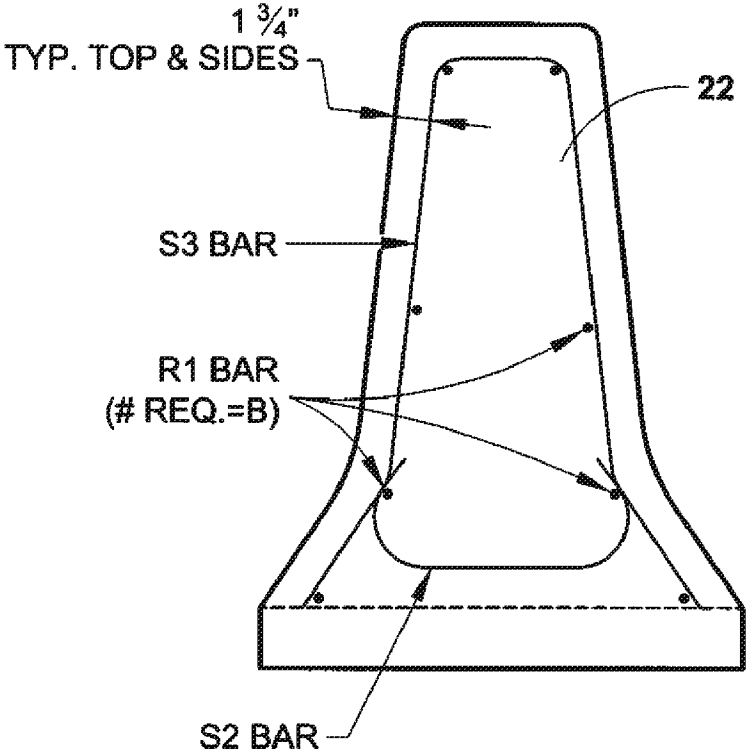
FIG. 11 shows an end elevation view of the present barrier indicating the placement of the reinforcement bars S2 and S3.
Figure 10:
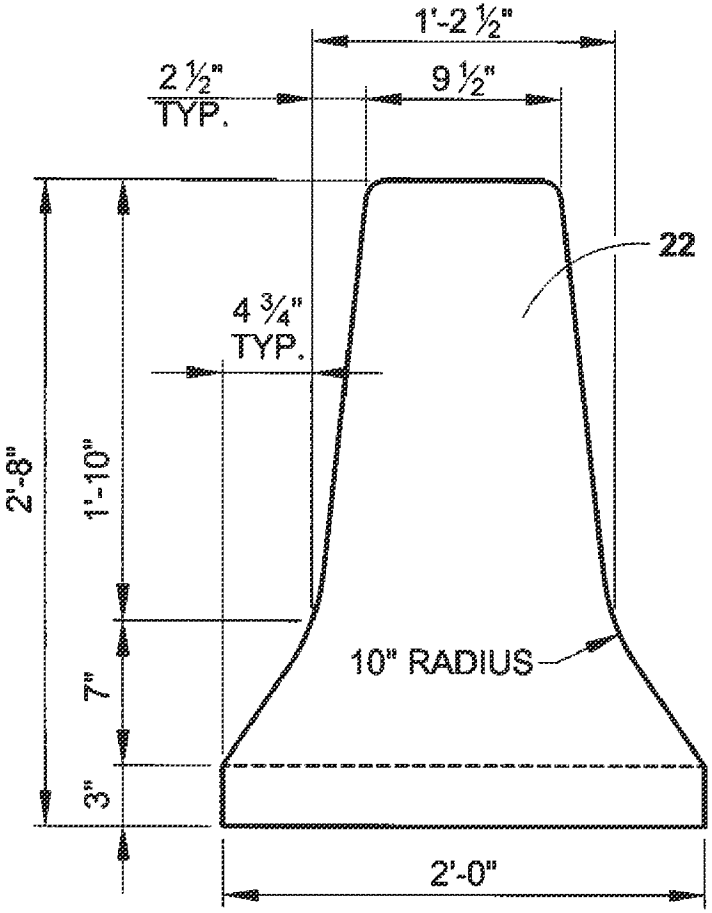
FIG. 10 shows an end elevation view of the profile of the present barrier indicating typical dimension of the structure.
Figure 13:
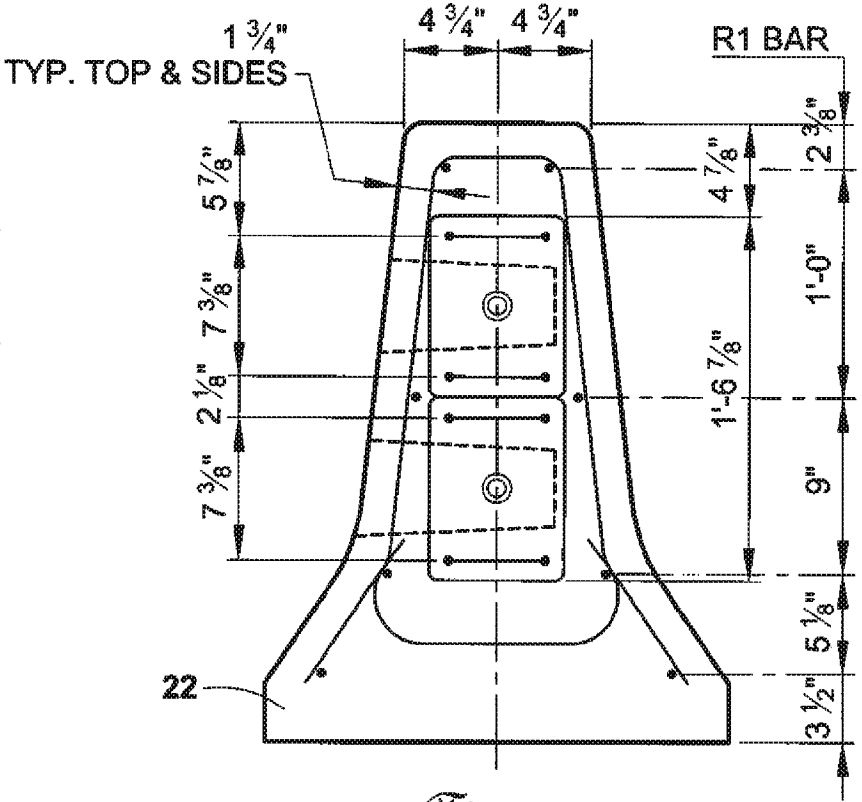
FIG. 13 shows an end elevation view of the present barrier showing the placement of reinforcement bars R1.
Figure 12:
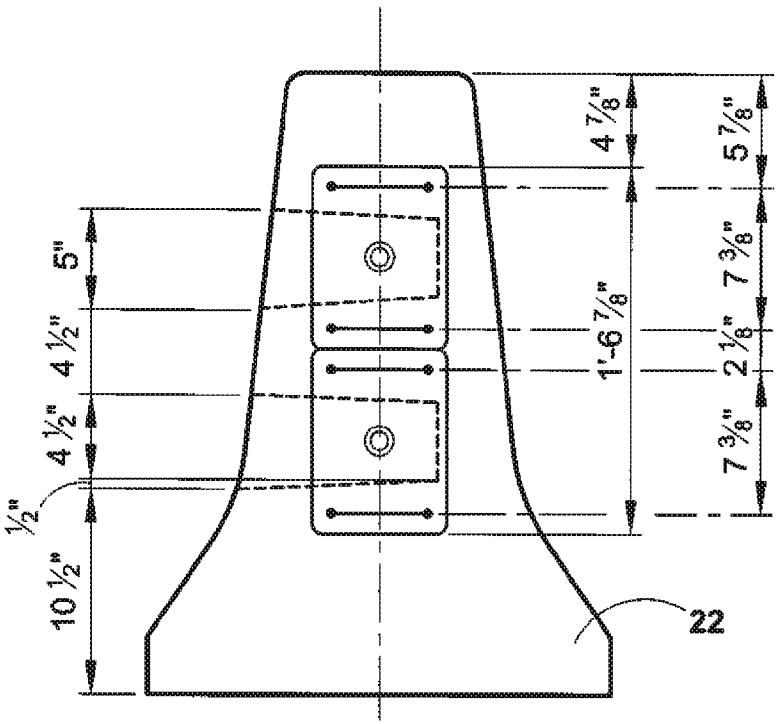
FIG. 12 shows an end elevation view of the present barrier indicating the placement of the reinforcement bars A and B relative to the hand holes and connector rods.

Reinforcement of the precast concrete barrier segment 22 is illustrated in FIGS. 8 and 9 wherein the various reinforcement bars (S3 bars, A and B bars, R1 bars, and S2 bars) are shown in their preferred locations, distances, and dimensions.

Figure 14B:
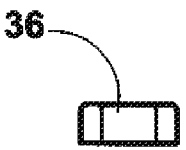
FIG. 14B shows the fastening nut of the present invention.

FIGS. 10-13 show the relationship of the reinforcement bars from an end elevation view of the F-shape barrier segment 22. FIGS. 14A-C illustrate the simple hardware utilized in forming the coupling of the present invention; namely, rod 34 threaded at both ends, fastener nut 36, and retaining washer 38.

The shapes and dimensions of the reinforcing bars are illustrated in FIGS. 15A-15E.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A coupling system for a traffic barricade comprising:

a first traffic barrier segment having an upstream end and a downstream end, each of said ends of said first traffic barrier segment having upper and lower connecting rod sleeve shafts, upper and lower hand holes, and upper and lower bolt retraction cavities;

a second traffic barrier segment having an upstream end and a downstream end, each of said ends of said second traffic barrier segment having upper and lower connecting rod sleeve shafts, upper and lower hand holes, and upper and lower bolt retraction cavities;

a first connector movable from a first retract position in said upper retraction cavity of said first barrier segment to a second coupled position wherein an end of said first connector extends through said upper connecting rod shaft in said second traffic barrier securing abutment of said first and second traffic barrier segments; and a second connector movable from a first retract position in said lower retraction cavity of said first barrier segment to a second coupled position wherein an end of said second connector extends through said lower connecting rod shaft in said second traffic barrier additionally securing said abutment of said first and second traffic barrier segments.

2. The coupling system of claim 1, wherein each said barrier segment has a longitudinal axis extending from said upstream end to said downstream end, each of said connecting rod sleeve shafts and each of said bolt retraction cavities extends generally longitudinally parallel to said barrier segment longitudinal axis.

3. The coupling system of claim 1, wherein each of said upper and lower bolt retraction cavities has a depth approximately equal to a length of a connecting rod of each of said connectors.

4. The coupling system of claim 1, wherein each of said barrier segments is adapted to retain and store connective hardware within a body portion of each of said segments.

5. The coupling system of claim 4, wherein said connective hardware comprises at least one connecting rod, at least one retaining washer, and at least one fastener nut, each of said retaining washer having a size greater than a size of said connecting rod sleeve shafts.

6. The coupling system of claim 5, wherein each of said upper and lower hand holes has an access opening into said body portion extending generally perpendicularly to a vertical centerline of said segment and generally perpendicularly to said longitudinal axis of said segment.

7. A coupling system for a traffic barricade comprising:

a first traffic barrier segment having an upstream end and a downstream end, each of said ends of said first traffic barrier segment having upper and lower connecting rod sleeve shafts, upper and lower hand holes, and upper and lower bolt retraction cavities;

a second traffic barrier segment having an upstream end and a downstream end, each of said ends of said second traffic barrier segment having upper and lower connecting rod sleeve shafts, upper and lower hand holes, and upper and lower bolt retraction cavities;

a first connector movable from a first retract position in said upper retraction cavity of said first barrier segment to a second coupled position wherein an end of said first connector extends through said upper connecting rod shaft in said second traffic barrier securing abutment of said first and second traffic barrier segments;

a second connector movable from a first retract position in said lower retraction cavity of said first barrier segment to a second coupled position wherein an end of said second connector extends through said lower connecting rod shaft in said second traffic barrier additionally securing said abutment of said first and second traffic barrier segments;

each said barrier segment having a longitudinal axis extending from said upstream end to said downstream end, each of said connecting rod sleeve shafts and each of said bolt retraction cavities extends generally longitudinally parallel to said barrier segment longitudinal axis;

each of said upper and lower bolt retraction cavities having a depth approximately equal to the length of a connecting rod of each of said connectors;

each of said barrier segments adapted to retain and store connective hardware within a body portion of each of said segments; and said connective hardware comprising at least one said connecting rod, at least one retaining washer, and at least one fastener nut, each said retaining washer having a size greater than a size of said connecting rod sleeve shafts.

8. The coupling system of claim 7, wherein each of said barrier segments has an F-shaped profile.

* * * * *